US008529096B2

(12) United States Patent
Zeng et al.

(10) Patent No.: US 8,529,096 B2
(45) Date of Patent: Sep. 10, 2013

(54) MECHANICAL INTERFACE FOR GLASS BULB FOR USE IN SOLID STATE LIGHT SOURCE RETROFIT LAMPS

(75) Inventors: Yichong Zeng, Chelmsford, MA (US); Hong Luo, Andover, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 316 days.

(21) Appl. No.: 12/907,975

(22) Filed: Oct. 19, 2010

(65) Prior Publication Data

US 2011/0089861 A1 Apr. 21, 2011

Related U.S. Application Data

(60) Provisional application No. 61/252,829, filed on Oct. 19, 2009.

(51) Int. Cl.
*F21V 29/00* (2006.01)

(52) U.S. Cl.
USPC ..... 362/294; 362/373

(58) Field of Classification Search
USPC ..... 362/311.01, 294, 457, 373, 276, 362/802
See application file for complete search history.

(56) References Cited

U.S. PATENT DOCUMENTS

| | | | | |
|---|---|---|---|---|
| 2,271,836 | A | 2/1942 | Francis | |
| 3,336,474 | A | 8/1967 | Leibl | |
| 3,596,078 | A | 7/1971 | Owens | |
| 4,434,455 | A | 2/1984 | Merritt | |
| 4,679,126 | A * | 7/1987 | Van Sickler | 362/654 |
| 6,123,433 | A * | 9/2000 | Chen | 362/654 |
| 6,227,683 | B1 | 5/2001 | Tukia | |
| 6,338,565 | B1 | 1/2002 | Fager et al. | |
| 6,491,415 | B2 | 12/2002 | Orellana | |
| 6,644,834 | B2 | 11/2003 | Christen | |
| 6,776,511 | B1 * | 8/2004 | Lindsay | 362/377 |
| 2002/0085392 | A1 | 7/2002 | Hajianpour | |
| 2003/0147245 | A1 | 8/2003 | Chen | |
| 2003/0161149 | A1 | 8/2003 | Eaton | |
| 2005/0243550 | A1 | 11/2005 | Stekelenburg | |

(Continued)

FOREIGN PATENT DOCUMENTS

JP 2007-522606 A 8/2007

OTHER PUBLICATIONS

Hyun Chae Song, International Search Report and Written Opinion of the International Searching Authority, Jun. 2, 2011, pp. 1-7, Korean Intellectual Property Office, Daejeon, Republic of Korea.

*Primary Examiner* — Evan Dzierzynski
*Assistant Examiner* — Danielle Allen
(74) *Attorney, Agent, or Firm* — Shaun P. Montana

(57) ABSTRACT

A mechanical interface for a glass bulb is provided. The mechanical interface includes a connector and an optical mount. The connector is in contact with the glass bulb. The connector may be a separate component attached to the glass bulb, or may be a continuous part of the glass bulb, such that the connector is itself made of glass. The optical mount is configured to receive the connector. In so receiving, the optical mount operatively couples with the connector so as to secure the glass bulb in a position. The optical mount is also configured to attach to a lamp housing. A solid state light source retrofit lamp may thus be formed of a lamp housing including a solid state light source light engine and its required components, a glass bulb, and a mechanical interface for the glass bulb.

9 Claims, 5 Drawing Sheets

(56) References Cited

U.S. PATENT DOCUMENTS

2006/0005947 A1 1/2006 Arik et al.
2007/0153531 A1* 7/2007 Lin ..... 362/362
2007/0159828 A1 7/2007 Wang

* cited by examiner

MECHANICAL INTERFACE FOR GLASS BULB FOR USE IN SOLID STATE LIGHT SOURCE RETROFIT LAMPS

CROSS-REFERENCE TO RELATED APPLICATION

The present application claims priority of U.S. Provisional Patent Application Ser. No. 61/252,829, filed Oct. 19, 2009, the entire contents of which are hereby incorporated by reference.

TECHNICAL FIELD

The present invention relates to lighting, and more specifically, to mechanically connecting a glass bulb to a solid state light source retrofit lamp.

BACKGROUND

Glass bulbs have been widely used for incandescent lamps since their initial creation. The process for shaping glass into conventional bulb-shapes (e.g., A19, B10, G25, etc.) and then connecting the bulb to a conventional base (e.g., screw-type base) is well known in the art and has been practiced for over a century.

With the advent of solid state light sources (e.g., light emitting diodes (LEDs)), and their use in lighting applications, particularly retrofit applications, bulbs of materials other than glass have typically been used. For example, plastic is sometimes used in retrofit lamps incorporating solid state light sources. Plastic bulbs reduce the weight of a retrofit lamp, which may be considerable, particularly if the lamp includes a metal or primarily metal thermal management system (i.e., heat sink) to dissipate the large amounts of heat generated by the solid state light source(s) within the lamp. Plastic bulbs may also provide greater design flexibility in comparison with glass bulbs.

SUMMARY

Conventional techniques that use a plastic bulb in place of a glass bulb in a solid state light source retrofit lamp suffer from a variety of deficiencies. Though plastic bulbs may provide greater design flexibility, it is very hard (and costly) to make a plastic bulb that mimics the typical crystallized appearance of a glass bulb, and achieves the same optical and thermal effect. Further, while greater design flexibility may result in a plastic bulb that is, in some aspects, pleasing to look at, consumers frequently want a retrofit lamp that looks very similar, if not the same as, to their existing incandescent lamps. In some instances, a different shape of bulb may not fit appropriately within a given fixture and/or and lamp shade. It is one thing to replace an incandescent bulb with a new retrofit bulb that is more energy efficient and will last far longer. It is another thing to have to replace not just the bulbs, but the entire fixture, or table lamp, or torchiere lamp, or the like. That imposes far greater costs on consumers, and may make consumers less likely to switch to retrofit lamps.

Using a glass bulb on a retrofit lamp is, however, not without its own problems. Typically in a retrofit lamp, the glass bulb is glued, or otherwise bonded using a bonding agent, to the rest of the lamp. The bonding process is often a messy procedure, requiring clean up on the exterior and possibly the interior of the lamp. Further, to avoid contaminating the solid state light sources and/or their necessary electrical components (e.g., a driver), as well as other internal components of the lamp, complicates the bonding process. On a high-speed assembly line, this complication may result in having to purchase new, costly equipment that would not be necessary for traditional lamps.

Embodiments of the present invention provide various mechanical interfaces to attach a glass bulb to a solid state light source-based retrofit lamp. These embodiments allow for easy attachment of the glass bulb to any retrofit lamp, particularly those that may include a thermal management system (i.e., heat sink) as part of the lamp housing. Should the glass bulb ever break during the long life of the solid state light source, using the invention, the broken glass bulb may be removed and replaced with a new glass bulb. This allows a user to get more life out of an otherwise perfectly useful light source, particularly a light source that may be as expensive as a solid state light source retrofit lamp. In some embodiments, the mechanical interface may be one modular piece of the retrofit lamp, and the removable nature of the glass bulb may allow a user to replace a failed light source within the lamp without having to replace the entirety of an otherwise perfectly useful lamp. Further, in some embodiments, a user may wish to replace a glass bulb of a first type (e.g., a clear glass bulb) with a glass bulb of a second type (e.g., a frosted glass bulb), for a particular application, event, time frame, or the like. Embodiments allow a user this kind of flexibility without having to go to the expense of purchasing a large number of retrofit lamps, one for each different desired application etc.

In an embodiment, there is provided a mechanical interface for a glass bulb. The mechanical interface for a glass bulb includes a connector in contact with the glass bulb and an optical mount. The optical mount is configured to receive the connector and, in so receiving, to operatively couple with the connector so as to secure the glass bulb in a position. The optical mount is configured to attach to a lamp housing.

In a related embodiment, the connector may include a sleeve, wherein the sleeve may be shaped to fit on a portion of the glass bulb that defines an opening, the sleeve including a connector mechanism to operatively couple with the optical mount. In a further related embodiment, the sleeve may be bonded to the glass bulb. In a further related embodiment, the connector mechanism may be a plurality of posts, wherein at least one post of the plurality of posts may extend radially from the sleeve.

In another related embodiment, the connector may be made of glass and may be a continuous part of the glass bulb. In a further related embodiment, the connector may be a plurality of posts, wherein at least one post of the plurality of posts may extend radially from the bulb. In another further related embodiment, the connector may be located near a portion of the glass bulb that defines an opening, the opening to receive a light engine coupled to the lamp housing.

In yet another related embodiment, the optical mount may further include a light engine attachment mechanism configured to receive a light engine and to hold the received light engine in a position relative to the glass bulb.

In still another related embodiment, the mechanical interface for a glass bulb may further include a base cover, wherein the base cover may be configured to receive the connector and, in so receiving, to operatively couple with the connector so as to secure the glass bulb in a position, and wherein the base cover may be configured to connect to the optical mount, and wherein the optical mount may include an optical mount having a first end and a second end, wherein the second end of the optical mount may be configured to attach to a lamp housing, and wherein the first end of the optical mount may be configured to connect to the base cover. In a further related embodiment, the optical mount may further include a light engine attachment mechanism configured to receive a light engine and to hold the received light engine in a position relative to the glass bulb.

In yet still another related embodiment, the optical mount may include a first clamp and a second clamp configured to operatively couple to each other and to receive the connector and, in so receiving, to operatively couple with the connector so as to secure the glass bulb in a position, and wherein the optical mount may be configured to attach to a lamp housing.

In another embodiment, there is provided a retrofit lamp. The retrofit lamp includes a lamp housing, a glass bulb, and a mechanical interface for the glass bulb. The lamp housing includes: a light engine including at least one solid state light source; a base configured to connect to a power source; a control circuit coupled to the base and to the light engine, wherein the control circuit is configured to receive power from the power source via the base and to provide the power to the at least one solid state light source of the light engine; and a thermal management system configured to dissipate thermal energy generated within the lamp. The mechanical interface for the glass bulb includes: a connector in contact with the glass bulb; and an optical mount, wherein the optical mount is configured to receive the connector and, in so receiving, to operatively couple with the connector so as to secure the glass bulb in a position, and wherein the optical mount is configured to attach to the lamp housing such that the glass bulb surrounds at least a portion of the light engine.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

As used herein, the term "solid state light source" includes one or more light emitting diodes (LEDs), organic light emitting diodes (OLEDs), and the like. As used herein, the term "lamp" refers to a light bulb and thus includes a base (e.g., screw-type, GU24, etc.) to connect the lamp to a socket so as to receive power, a light source, an electrical connection between the base and the light source, and a glass bulb that at least partially surrounds the light source. Depending on the type, a lamp may include further components, such as a fill gas (for an incandescent lamp), a thermal management system (for a solid state light source lamp), a phosphor (for a fluorescent lamp), and the like. The light source may vary depending on the type of lamp. As used herein, the term "light engine" refers to a solid state light source coupled to an optical component, or an electrical component, or both, that is capable of serving as the light source for a lamp. As used herein, the term "post" refers to a protrusion of any size and/or shape that extends in an outward direction and, when placed into an appropriate receptacle, serves to form a mechanical coupling between the component(s) to which it is attached and the receptacle.

Figure 1:
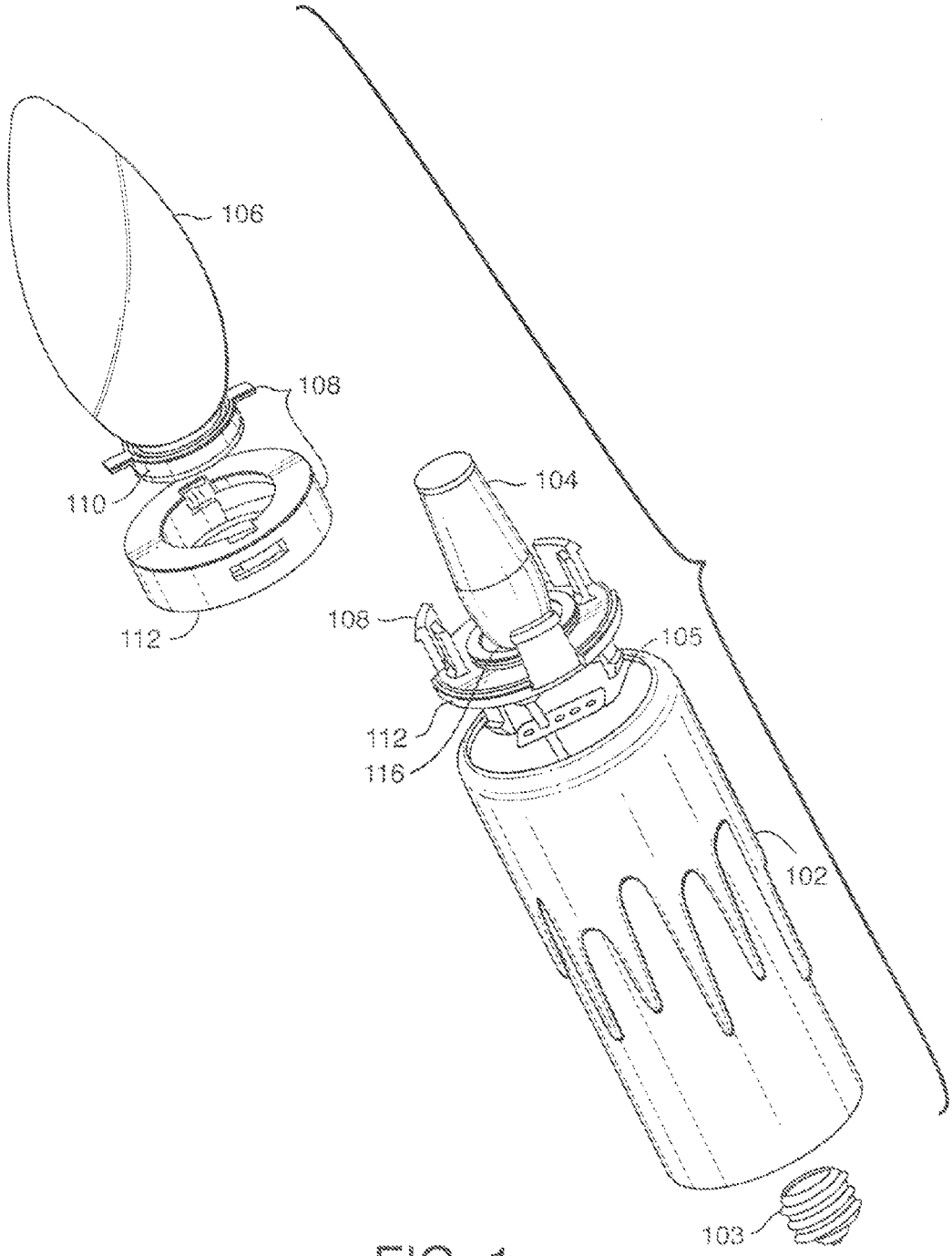
FIG. 1 shows an exploded view of a retrofit lamp including a mechanical interface for a glass bulb according to embodiments disclosed herein.

FIG. 1 shows a solid state light source retrofit lamp 100. The retrofit lamp 100 is capable of being placed into a conventional lamp socket and receiving power therefrom. The retrofit lamp 100 includes a lamp housing 102. The lamp housing 102 includes a base 103, configured to connect to a power source, and a light engine 104, that itself includes at least one solid state light source. The base 103 may be, but is not limited to, a conventional lamp base configured to connect to a power source. In some embodiments, the base 103 is capable of being connected to a conventional socket that provides power to the retrofit lamp 100. The light engine 104, in some embodiments, includes a driver circuit 105, while in other embodiments, the driver circuit 105 is not part of the light engine 104. The driver circuit 105 is coupled to the base 103 and to the at least one solid state light source within the light engine 104, and provides power to the at least one solid state light source of the light engine 104 from the base 103. The driver circuit 105 may, in some embodiments, include control circuitry to control the at least one solid state light source of the light engine 104 in addition to turning it on and off (i.e., driving it), and may thus also be referred to as a control circuit. The lamp housing 102 may also include a thermal management system that is configured to dissipate thermal energy generated within the retrofit lamp 100. The thermal management system may be any type of material and/or device that is capable of dissipating thermal energy (i.e., a heat sink). As shown in FIG. 1, the thermal management system is part of the lamp housing 102.

Figure 3:
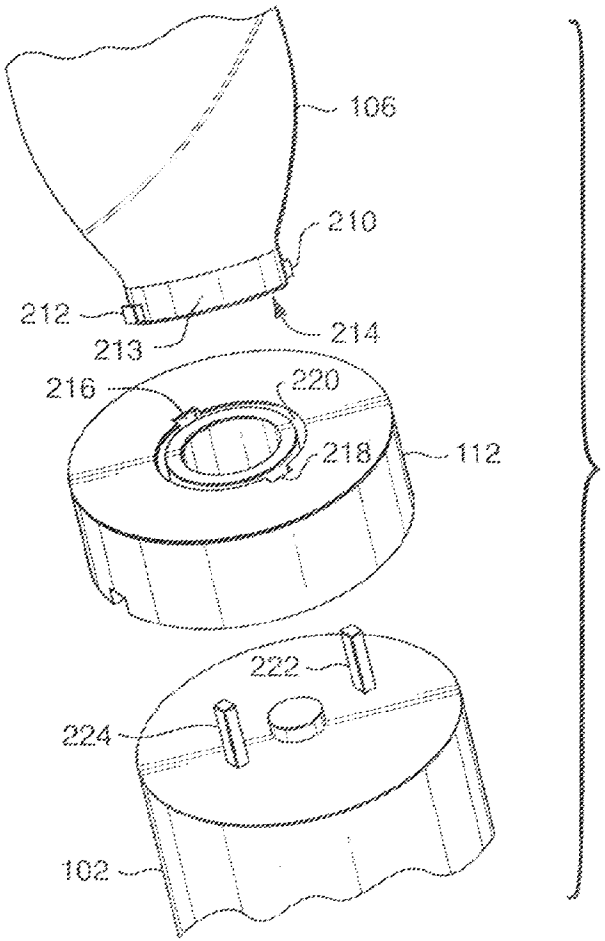
FIG. 3 shows a close up exploded view of a glass bulb including a connector, an optical mount, and a lamp housing according to embodiments disclosed herein.

The retrofit lamp 100 also includes a glass bulb 106 that surrounds the light engine 104. The glass bulb 106 is attached to the lamp housing 102 via a mechanical interface 108 for the glass bulb. The mechanical interface 108 includes a connector 110 and an optical mount 112. The connector 110 serves to mechanically attach the glass bulb 106 to the optical mount 112, and thus the connector 110 may take any shape and/or form that allows for such a mechanical connection. The connector 110 is in contact with the glass bulb 106. As shown in FIG. 1, and elsewhere, the connector 110 in some embodiments is a separate piece from the glass bulb 106 and must be attached to the glass bulb 106, as is described in greater detail below. In other embodiments, such as is shown in FIG. 3, the connector 110 is made of glass and is a continuous part of the glass bulb 106. The optical mount 112, which may have two (or more) parts as shown in FIG. 1, or may be a single part as shown for example in FIG. 3, is configured to receive the connector 110. In so receiving the connector 110, the optical mount 112 operatively couples with the connector 110 so as to secure the glass bulb 106 to the lamp housing 102, which the optical mount 112 attaches to. Thus, the mechanical interface 108 secures the glass bulb 106 in a particular position, such as but not limited to a position that surrounds the at least a portion of the light engine 104. In some embodiments, the optical mount 112 additionally includes a light engine attachment mechanism 116. The light engine attachment mechanism 116 is configured to receive the light engine 104 and to hold the received light engine 104 in a position relative to the glass bulb 106. The light engine attachment mechanism 116 is thus any type of mechanical connector that is able to hold the light engine 104 in a particular position.

Figure 2:
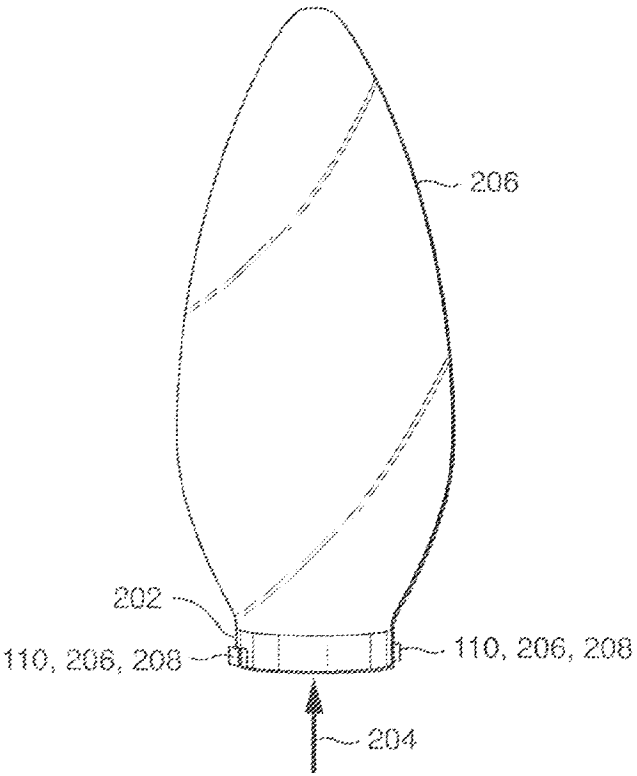
FIG. 2 shows a close up view of a glass bulb and portion of a mechanical interface for the glass bulb according to embodiments disclosed herein.

FIGS. 2-7 show elements of the mechanical interface 108 of FIG. 1 in greater detail. In FIG. 2, the glass bulb 106 is in contact with the connector 110. The connector 110 as shown is a sleeve 110 that is shaped to fit on a bottom portion 202 of the glass bulb 106, wherein the bottom portion 202 defines an opening 204. The sleeve 110 may be attached to the glass bulb 106 in any known way, such as but not limited to via bonding. Thus, for example, the sleeve 110 may be glued to the glass bulb 106, affixed via cement, or otherwise attached using a bonding agent. Other known bonding techniques, such as but not limited to fire bonding and the like, may also be used to attach the sleeve 110 to the glass bulb 106. The sleeve 110 includes a connector mechanism 206, 208 that allows the sleeve 110 and the glass bulb 106 to be coupled with the optical mount. The connector mechanism 206, 208 may be any type of connector that forms a mechanical connection between the sleeve 110 (and thus the glass bulb 106) and the optical mount. As shown in FIG. 2, the connector mechanism 206, 208 comprises two posts 206, 208 that extend radially from the sleeve 110. The number of posts may vary depending on the size of the glass bulb 106 and/or the strength of the desired connection between the glass bulb 106 and the sleeve 110, and the optical mount. Thus, in some embodiments, a single post may be all that is required to attach the glass bulb 106 to the optical mount. In some embodiments, the posts 206, 208 may be of the same and/or similar shape and/or size, while in other embodiments, the posts 206, 208 may be of different shape and/or size. Such a configuration may allow the glass bulb 106 and the sleeve 110 to be attached to the optical mount in only one way, to guarantee that the glass bulb 106 takes a particular position in relation to the lamp housing, light engine, etc.

FIG. 3 shows a close up of an exploded view of a glass bulb 106, an optical mount 112, and a lamp housing 102. Here, the glass bulb 106 does not have a separate connector, such as the sleeve 110 shown in FIG. 2. Rather, in FIG. 3 the connector is made of glass and is a continuous part of the glass bulb 106, such that it is not a separate component. When the connector is part of the glass bulb 106, the connector may take any shape that allows for mechanical coupling between the glass bulb 106 and the optical mount 112. As shown in FIG. 3, the connector is two posts 210, 212 extending radially from the glass bulb 106. The two posts 210, 212 may, as with the posts 206, 208 in FIG. 2, be of any size and/or shape, including being the same, similar, or different. Of course, as with the posts 206, 208 in FIG. 2, a single post may be all that is required to attach the glass bulb 106 to the optical mount 112. The two posts 210, 212 are located near a portion 213 of the glass bulb 106 that defines an opening 214. The opening 214 is to receive a light engine, such as the light engine 104 shown in FIG. 1, that is coupled to a lamp housing, such as the lamp housing 102 shown in FIG. 1.

Figure 5:
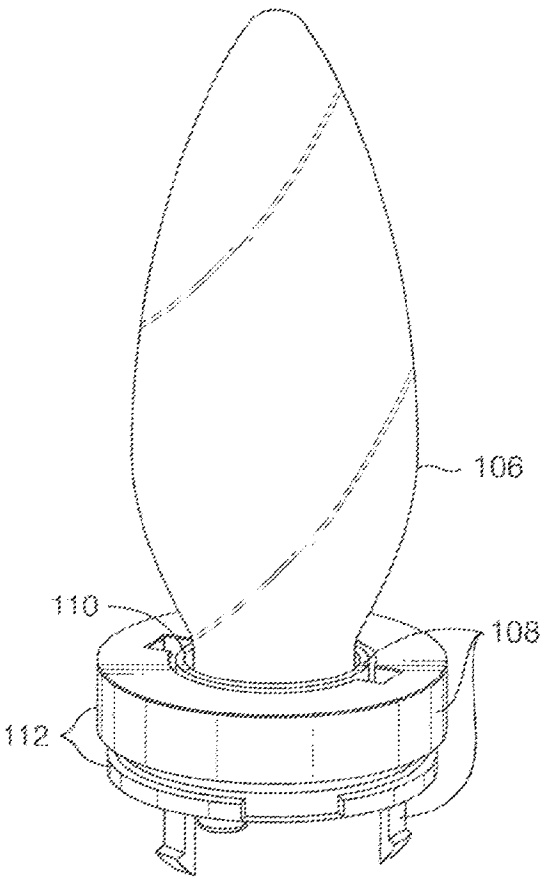
FIG. 5 shows a glass bulb and its mechanical interface when attached to each other, but not attached to a lamp housing, according to embodiments disclosed herein.
Figure 4:
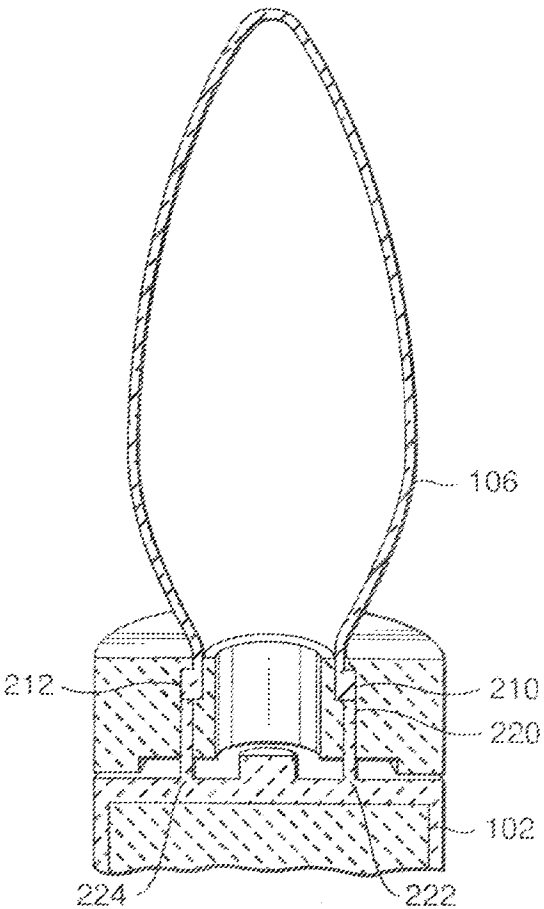
FIG. 4 shows a side cross section view of the glass bulb including a connector, the optical mount, and the lamp housing of FIG. 3, when these components are attached to each other according to embodiments disclosed herein.

The optical mount 112 shown in FIG. 3, as with the optical mount 112 shown in FIG. 1, is configured to receive the two posts 210, 212. Thus, in FIG. 3, the optical mount 112 includes two openings 216, 218, into which the two posts 210, 212 fit. The glass bulb 106, and the two posts 210, 212 that are part of the glass bulb 106, are then rotated within a groove 220 so that the two posts 210, 212 are not in line with the two openings 216, 218. Thus, the glass bulb 106 is secured in a position. In receiving the two posts 210, 212, the optical mount 112 is operatively coupled with the two posts 210, 212. This is seen most clearly in the cross-section view of FIG. 4, where the glass bulb 106, the optical mount 112, and the lamp housing 112 are all operatively connected together. The two posts 210, 212 rest within the groove 220 of the optical mount 112, securing the glass bulb 106. Referring back to FIG. 3, the optical mount 112 itself is attached to the lamp housing 112 via two long housing posts 222, 224, though of course any number of housing posts, or any other suitable attachment mechanism, may be used. As seen in FIG. 4, the two long housing posts 222, 224 may, in some embodiments, serve a dual purpose of connecting the optical mount 112 to the lamp housing 102 and assisting to retain the glass bulb 106 in a particular position once the glass bulb 106 is attached to the optical mount 112. In some embodiments, the two long housing posts 222, 224 may additionally prevent the glass bulb 106 from being removed from the lamp housing 102 without first removing the optical mount 112 from the lamp housing 102. Thus, in some embodiments, as shown in FIG. 5, it is possible to remove the glass bulb 106 and the mechanical interface 108 (including the connector 110, whatever its form and however it is in contact with the glass bulb 106, and the optical mount 112) from the lamp housing 102 without damaging the retrofit lamp and/or the light engine contained therein.

Figure 6:
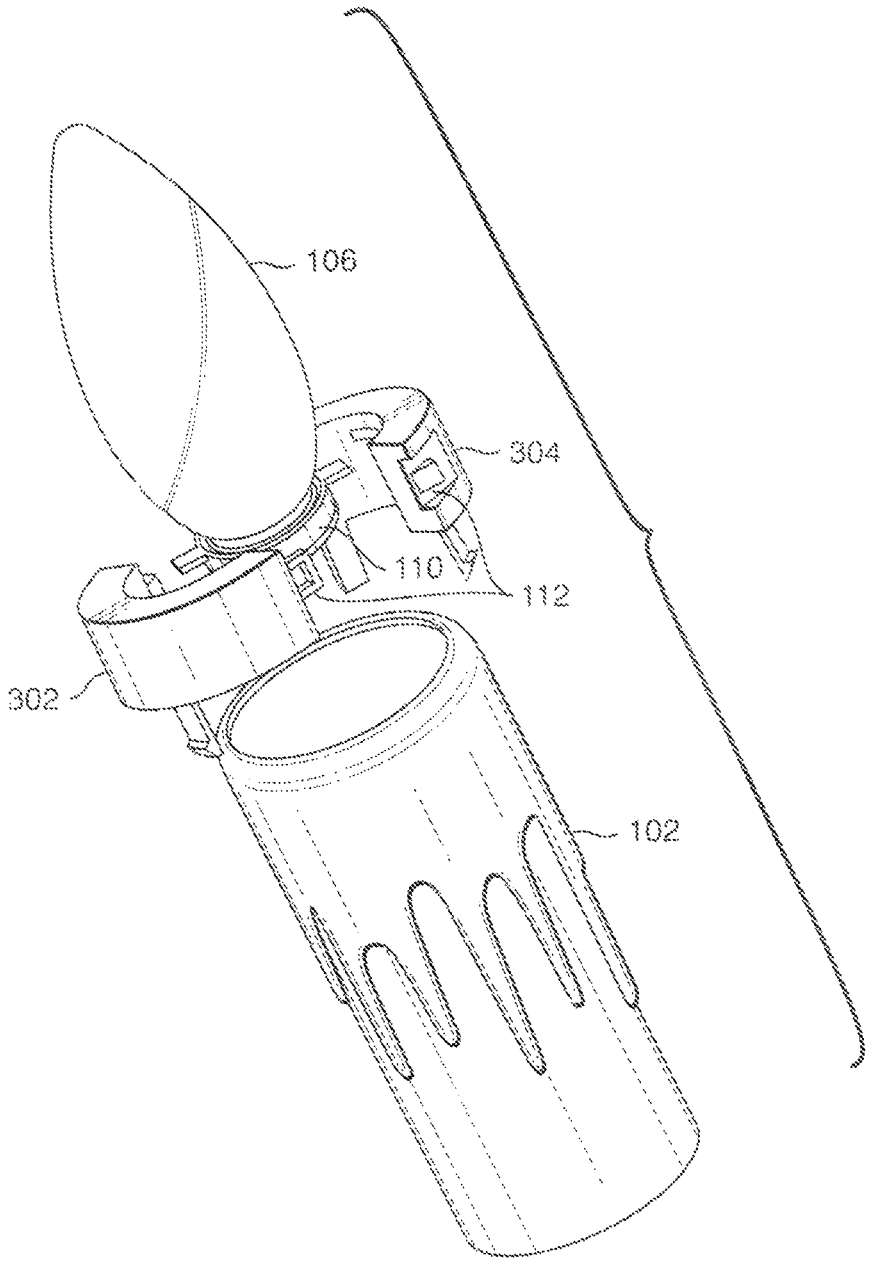
FIG. 6 shows a mechanical interface including an optical mount that is formed from two clamps, according to embodiments described herein.

In FIG. 6, the optical mount 112 is divided into two clamps 302, 304. The two clamps 302, 304 are configured to operatively couple both to each other and to the lamp housing 102. As with any optical mount 112, the two clamps 302, 304 are configured to receive the connector 110 and, in so receiving, to operatively couple with the connector 110 so as to secure the glass bulb 106 in a position. Of course, in some embodiments, the optical mount 112 may be divided into more than two clamps. The two clamps 302, 304 may be hinged or otherwise movable around the glass bulb 106 and the connector 110 when coupled together in at least one place, and then may be coupled in a second place when the glass bulb 106 is to be secured. The two clamps 302, 304 may thus adjust depending on the size and/or shape of the glass bulb 106, such that any number of different sizes and/or shapes of glass bulbs may be used with the same lamp housing 102. Further, the two clamps 302, 304 may also receive any number of different types of connectors, such that two different sized and/or shaped glass bulbs do not each have to have the same connector in order to be coupled to the same lamp housing 102.

Figure 7:
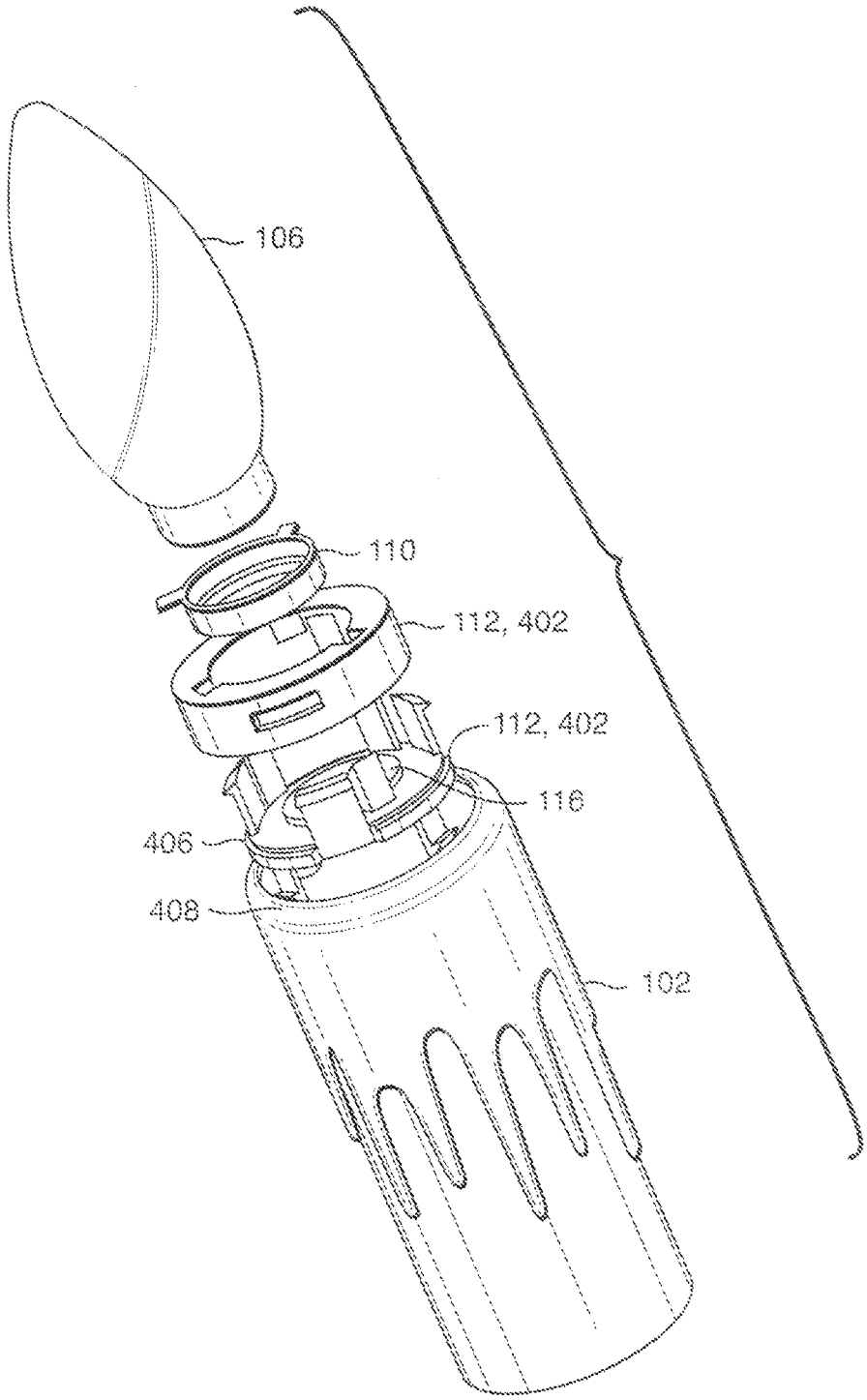
FIG. 7 shows an exploded view of a retrofit lamp including a mechanical interface for a glass bulb according to embodiments described herein.

FIG. 7 shows the optical mount 112 divided into two pieces, a base cover 402 and an optical mount 404. The base cover 402 is configured to receive the connector 110 and, in so receiving, to operatively couple with the connector 110 so as to secure the glass bulb 106 in a position. The base cover is also configured to connect to the optical mount 404. The base cover 402 provides an extra layer of connection for the glass bulb 106. This improves the strength of the connection between the glass bulb 106 and the optical mount 112. It also allows the optical mount 112 to be adapted so as to connect to the glass bulb in a first way, via the base cover 402, that may be particularly suited for that connection, and to also connect to the lamp housing 102 in a second way, via the optical mount 404, that may particularly suited for that connection. Simultaneously, or in some embodiments, additionally, the base cover 402 may act as a cover for the portion of the lamp housing 102 nearest to the glass bulb 106, concealing the optical mount 404 as well as the internal components of the retrofit lamp. Thus, the optical mount 404, in FIG. 7, has a first end 406 and a second end 408. The second end 408 is configured to attach to the lamp housing 102. The first end 406 of the optical mount 404 is configured to connect to the base cover 402. In some embodiments, the optical mount 404 may further include a light engine attachment mechanism 116 configured to receive a light engine (not shown in FIG. 7) and to hold the received light engine in a position relative to the glass bulb 106.

Though FIGS. 1-7 herein have shown a glass bulb in a conventional candelabra-style shape, of course any shape and/or size of glass bulb may be used with embodiments of the mechanical interface as described herein without departing from the scope of the invention.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A mechanical interface for a glass bulb, comprising:

a connector in contact with the glass bulb; and an optical mount, wherein the optical mount is configured to receive the connector and, in so receiving, to operatively couple with the connector so as to secure the glass bulb in a position, and wherein the optical mount is configured to attach to a lamp housing;

wherein the connector comprises a sleeve, wherein the sleeve is shaped to fit on a portion of the glass bulb that defines an opening, the sleeve including a connector mechanism to operatively couple with the optical mount and wherein the sleeve is bonded to the glass bulb; and wherein the connector mechanism is a plurality of posts, wherein at least one post of the plurality of posts extends radially from the sleeve.

2. The mechanical interface for a glass bulb of claim 1, wherein the connector is made of glass and is a continuous part of the glass bulb.

3. The mechanical interface for a glass bulb of claim 2, wherein the connector is a plurality of posts, wherein at least one post of the plurality of posts extends radially from the bulb.

4. The mechanical interface for a glass bulb of claim 2, wherein the connector is located near a portion of the glass bulb that defines an opening, the opening to receive a light engine coupled to the lamp housing.

5. The mechanical interface for a glass bulb of claim 1, wherein the optical mount further comprises a light engine attachment mechanism configured to receive a light engine and to hold the received light engine in a position relative to the glass bulb.

6. The mechanical interface for a glass bulb of claim 1, further comprising:

a base cover, wherein the base cover is configured to receive the connector and, in so receiving, to operatively couple with the connector so as to secure the glass bulb in a position, and wherein the base cover is configured to connect to the optical mount;

and wherein the optical mount comprises:

an optical mount having a first end and a second end, wherein the second end of the optical mount is configured to attach to a lamp housing, and wherein the first end of the optical mount is configured to connect to the base cover.

7. The mechanical interface for a glass bulb of claim 6, wherein the optical mount further comprises a light engine attachment mechanism configured to receive a light engine and to hold the received light engine in a position relative to the glass bulb.

8. The mechanical interface for a glass bulb of claim 1, wherein the optical mount comprises:

a first clamp and a second clamp configured to operatively couple to each other and to receive the connector and, in so receiving, to operatively couple with the connector so as to secure the glass bulb in a position, and wherein the optical mount is configured to attach to a lamp housing.

9. A retrofit lamp comprising:

a lamp housing, comprising:

a light engine including at least one solid state light source;

a base configured to connect to a power source;

a control circuit coupled to the base and to the light engine, wherein the control circuit is configured to receive power from the power source via the base and to provide the power to the at least one solid state light source of the light engine; and a thermal management system configured to dissipate thermal energy generated within the lamp;

a glass bulb; and a mechanical interface for the glass bulb, comprising:

a connector in contact with the glass bulb; and an optical mount, wherein the optical mount is configured to receive the connector and, in so receiving, to operatively couple with the connector so as to secure the glass bulb in a position, and wherein the optical mount is configured to attach to the lamp housing such that the glass bulb surrounds at least a portion of the light engine;

wherein the connector comprises a sleeve, wherein the sleeve is shaped to fit on a portion of the glass bulb that defines an opening, the sleeve including a connector mechanism to operatively couple with the optical mount and wherein the sleeve is bonded to the glass bulb; and wherein the connector mechanism is a plurality of posts, wherein at least one post of the plurality of posts extends radially from the sleeve.

* * * * *